US005347757A

United States Patent [19]

Losito

[11] Patent Number: 5,347,757

[45] Date of Patent: Sep. 20, 1994

[54] DEVICE FOR OPENING AND CLOSING A DOCK IN RAILWAY AND BUS CARS

[75] Inventor: Pietro Losito, Volvera, Italy

[73] Assignee: O.C.L.A.P. s.r.l., Piscina, Italy

[21] Appl. No.: 768,070

[22] PCT Filed: Mar. 20, 1990

[86] PCT No.: PCT/EP90/00456

§ 371 Date: Sep. 26, 1991

§ 102(e) Date: Sep. 26, 1991

[87] PCT Pub. No.: WO90/12184

PCT Pub. Date: Oct. 18, 1990

[30] Foreign Application Priority Data

Apr. 7, 1989 [IT] Italy ..... 67250 A/89

[51] Int. Cl.[5] ..... E05F 7/02

[52] U.S. Cl. ..... 49/255; 49/130; 49/210; 49/211

[58] Field of Search ..... 49/254, 257, 258, 260, 49/130, 128, 127, 209, 210, 211, 212, 213

[56] References Cited

U.S. PATENT DOCUMENTS

| | | | |
|---|---|---|---|
| 2,834,067 | 5/1958 | Beauchamp | 49/130 |
| 4,337,596 | 7/1982 | Kern et al. | 49/210 |
| 4,617,756 | 10/1986 | Dilcher | 49/212 |
| 4,702,514 | 10/1987 | Perry | 49/254 X |
| 4,845,890 | 7/1989 | Terada et al. | 49/130 |
| 4,942,694 | 7/1990 | Simoncelli | 49/254 X |

*Primary Examiner*—Peter M. Cuomo
*Assistant Examiner*—Jerry Redman
*Attorney, Agent, or Firm*—Paul & Paul

[57] ABSTRACT

A device is provided for opening and closing a door (5) in a doorway (7) of a structure (9) in a railway or bus car comprising an upper ejection assembly, a lower ejection assembly and a translation assembly, the upper ejection assembly further comprising a translation slide bar. The upper and lower ejection assemblies comprise rotation arms (1, 11) joined at one side to the fixed structure (9) by hinges (13) mounted through curved slots on respective brackets (15), and at the other side to a frame which is integral with the door (5). A slide bar (37) passes through the doorway (7) and is pivoted at one end to a movable end of the upper arm (1), and at the other end to a fixed bracket (47) on the other side of the doorway (7). After the door (5) has been separated from the doorway (7), the door is translated by means of a suitable rack (61) integral with the door, engaged by a gear wheel (59) which is driven through suitable gears (55, 57) by another rack (53) which in turn is driven by a rod (51) of a fluid actuated cylinder (49). According to one embodiment of the invention, the ejection assemblies are driven by at least one fluid pressure cylinder (20) the rod of which is secured to a rack (19) which engages a suitable gear wheel (21) keyed on a rotation shaft (23) of the ejection arms (1, 11) and causes their partial rotation, thus accomplishing the separation or ejection of the door (5) from the doorway (7) of the structure (9).

17 Claims, 4 Drawing Sheets

XI
37
31
51
49
63
53
15
3
01
1
9
5
55
57
59
61
45
39
47
41
43
29
02

DEVICE FOR OPENING AND CLOSING A DOCK IN RAILWAY AND BUS CARS

The present invention concerns a device for opening and closing a door in railway and bus cars.

It is well known that the operation of doors or leaves in railway and bus cars has been and is still of considerable interest for the manufacturers and the users of such vehicles: the system and the associated device for opening and closing the doors of said cars has to meet both requirements of practicability and efficiency, and safety requirements for ensuring a proper operation of the device and the passengers' safety.

The object of the present invention is to provide a safe and practical device for door opening and closing in railway and bus cars, adapted to stand the inner and outer stresses to which the car is generally subjected.

FR-A-2,310,235 discloses a device for opening and closing a door, particularly in railway cars, in which said door is ejected outside of the frame by suitable arms, and in this position it is displaceable longitudinally with respect to the frame on suitable guide means provided on and between the frame and the door. The arms therefore are only ejection means, which rotate partially with respect to their rotation point; no rotation occurs at the free ends of these arms, but only the aforementioned translation movement of the door with respect to the frame.

With the subject device it is proposed to impart the door an ejection or rotational movement in the opening cycle, followed by a translation movement that places the door in a stable position parallel to the side frame housing the doorway.

The closing cycle is obviously the reverse of the above mentioned opening one.

The subject device substantially comprises:

an upper ejection (rotation) drive assembly and a translation guide;

a door translation drive assembly;

a lower ejection (rotation) drive assembly;

the term ejection meaning a partial rotation of the arms secured to the fixed structure and to the door in order to accomplish the initial separation from and the final approach to the doorway of said door; the upper and lower ejection drive assemblies substantially comprising respective ejection drive arms joined at their base end, at the axis of rotation 01, 06, to respective fixed hinge members, and at their other free end to suitable supports secured to the door; said hinge members allowing for an angular rotation movement of the arms which is enough to accomplish the ejection of the door; the upper and lower ejection drive assemblies being connected together by a suitable torsion bar integral with the shafts, the bar synchronizing the movements of rotation of both assemblies; at their other end or free end said ejection arms being engaged by a clamp carrying a pivoted support with an associated slide bush; characterized in that the upper ejection drive assembly and the translation guide have variable centers; the hinge members are mounted on respective brackets through a curved slot fastening arrangement which allows the change of their angular attitude in such a way as to align the centers of rotation of the hinge members with the axis of rotation 01, 06 of said arms, said brackets secured to the structure that carries the doorway forming a first and a third linking points between the device and the structure; the drive means for said upper and lower ejection arms comprising at least a rack driven by a dedicated fluid pressure small cylinder, e.g. a hydraulic or pneumatic one, the rack engaging at least one gear wheel or gearing which is keyed to the shaft of rotation of the above mentioned ejection arms; the clamp carrying the pivoted support with the associated slide bush being engaged with respective upper and lower slide bars, at 02, that are integral with the door; such engagement coupling forming a first and a third back up points for the door; the end portion of the upper ejection arm carrying a support acting as a half hinge at 03, into which an additional support is fitted, a circular cross section slide bar fastened to said additional support being connected bridgewise to a further bush-pivot support, at 05, a sleeve provided with slide bushes being slidably mounted on said circular cross section bar, such sleeve being joined to the door through a pivoting between the relevant movable axis and the relevant bracket, said bracket forming the second back up point of the door; said bush-pivot support formed by a block drilled to accommodate the circular cross section slide bar being pivoted at 05 to a bracket thus realizing the second linking point between the device and the structure carrying the doorway; the door translation drive assembly substantially comprising a pneumatic or fluid pressure cylinder the rod of which is fastened to a rack in turn engaging a gear wheel which in turn meshes with another gear wheel coaxially to which an additional gear wheel is provided that in turn engages a further rack secured to the door to be translated; this assembly being connected, at the rear portion of the cylinder, to a hinge secured to the structure by one of the above illustrated half hinges; the whole assembly being integral with the upper ejection arm through the keying of the gear wheel to the pin that realizes the pivoting of axis 02.

The invention will now be disclosed with particular reference to the attached drawings, given as a non limiting example and illustrating a preferred embodiment of the invention, in which.

Figure 1:
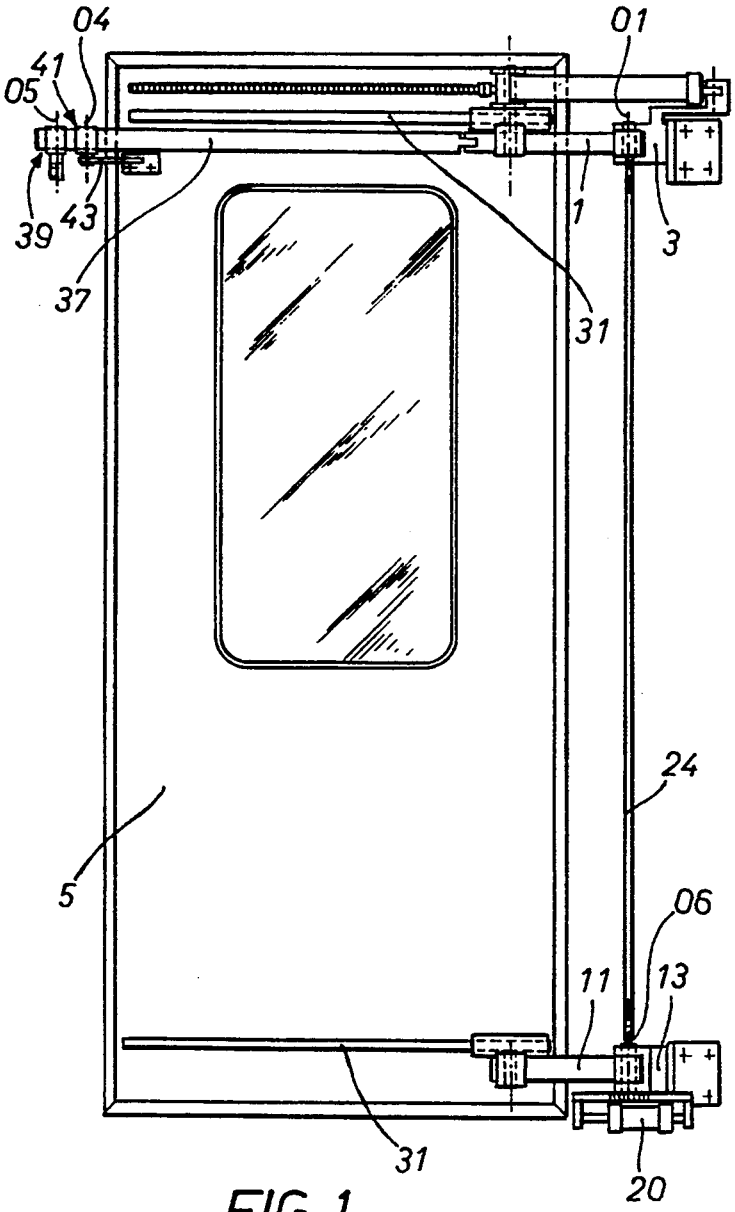
FIG. 1 is an overall front view of a door applied to a fixed structure, which incorporates the subject device.
Figure 2:
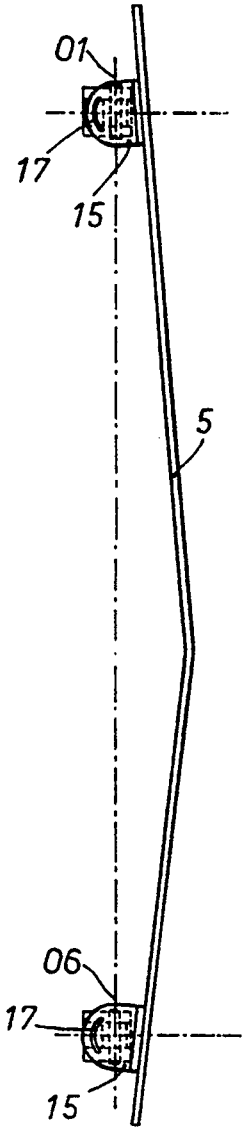
FIG. 2 is a schematic side view from the right side of FIG. 1 in which it is put in evidence the fastening system of the upper and lower members to the brackets.
Figure 3:
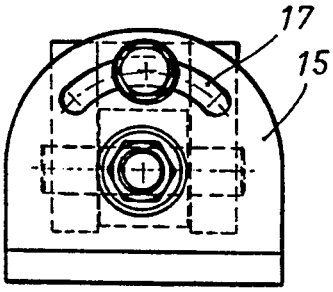
FIG. 3 is a detailed view of the slotted system for fastening the members to the brackets.
Figure 4:
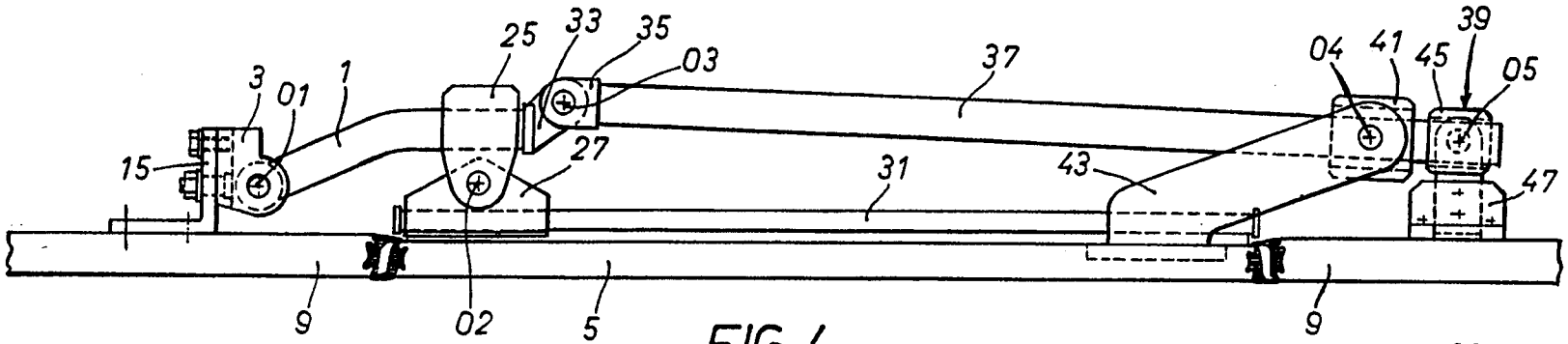
FIG. 4 is a schematic view of the subject device in the position of a closed door.
Figure 5:
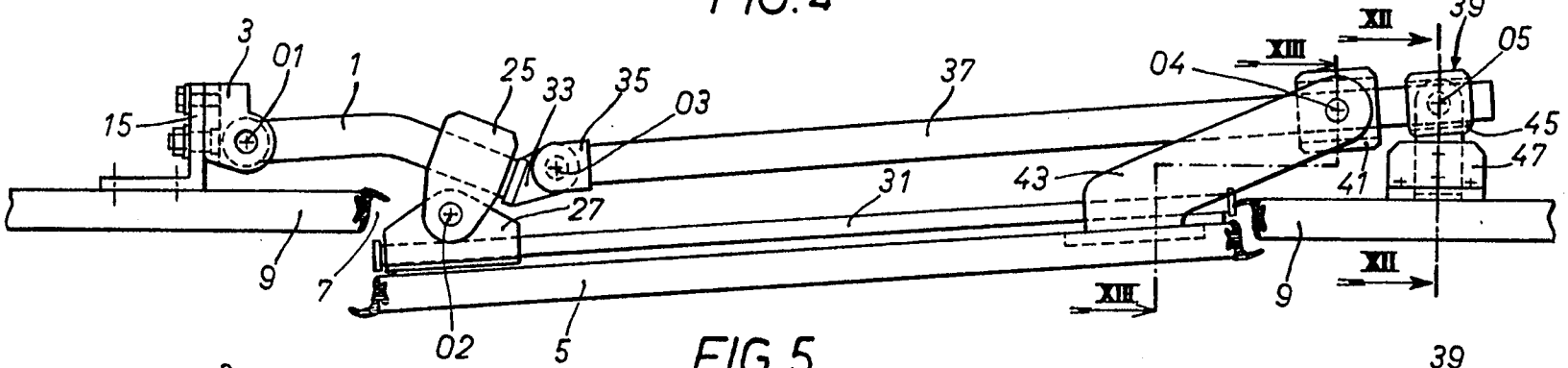
Figure 6:
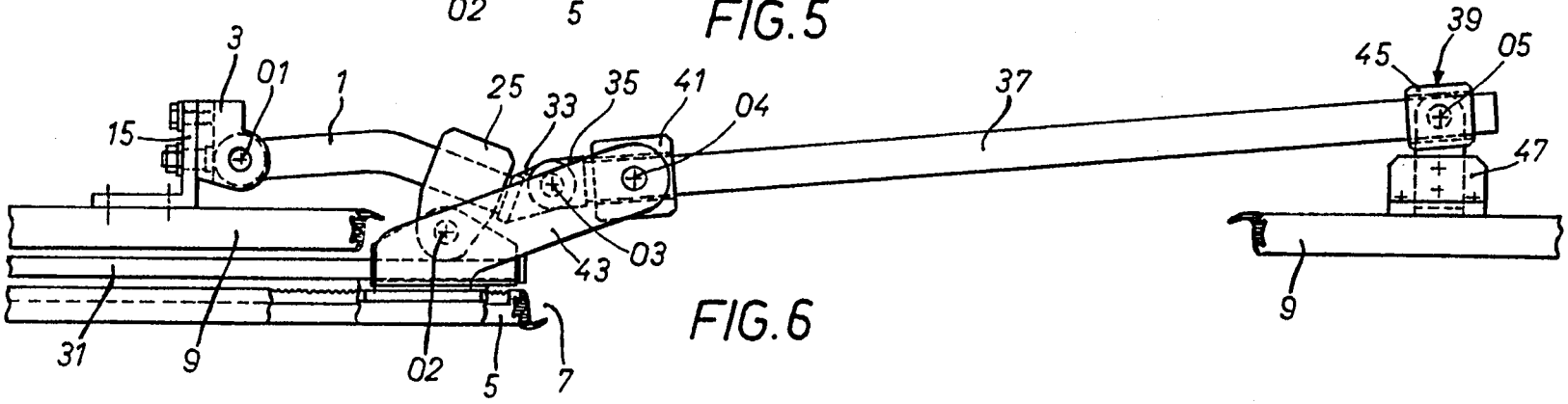
Figure 7:
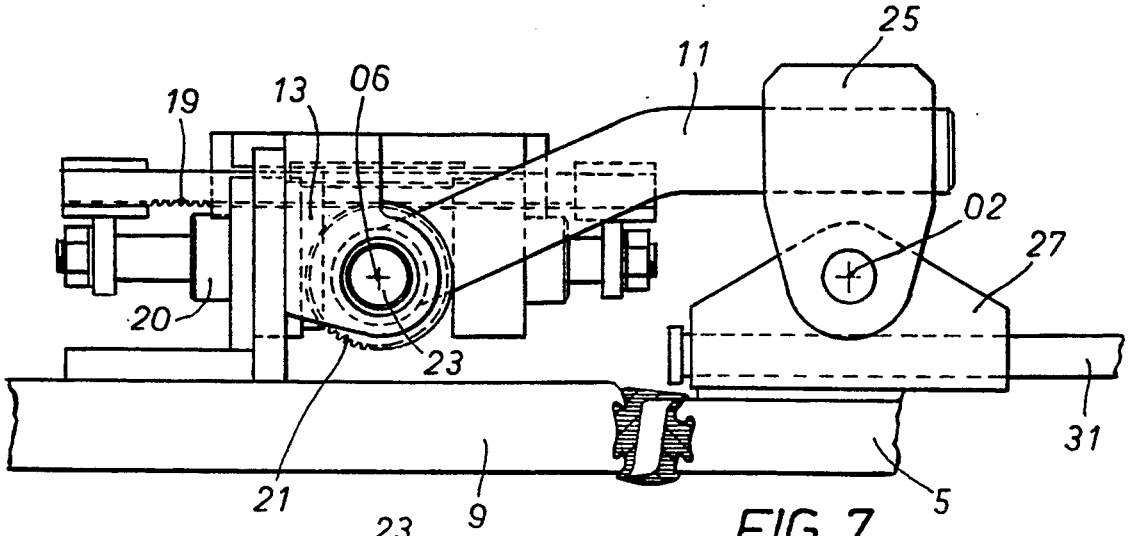
Figure 8:
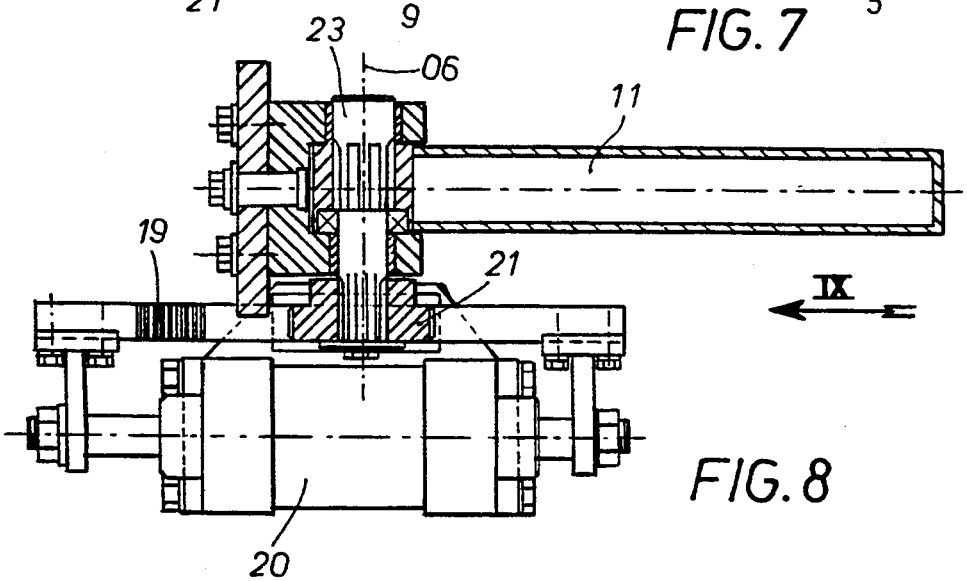

FIG. 5 if a schematic view, similar to FIG. 4, showing the device in the position where the opening or ejection (rotation) has been started;

FIG. 6 is a schematic view, similar to FIGS. 4 and 5, showing the subject device in the position where the door is opened and translated;

FIG. 7 is a schematic top view from FIG. 1 wherein the upper portion of FIG. 7 corresponds to the front view of FIG. 1, showing the device actuating the ejection arms;

FIG. 8 is a schematic cross sectioned side view of the device of FIG. 7 taken from the bottom of FIG. 7 and extending through the axis of rotation 06 of the shaft 23.

Figure 9:
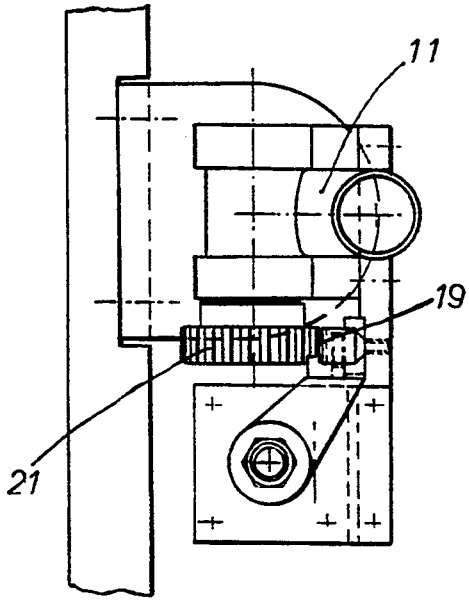
Figures 10, 11, 12, 13:
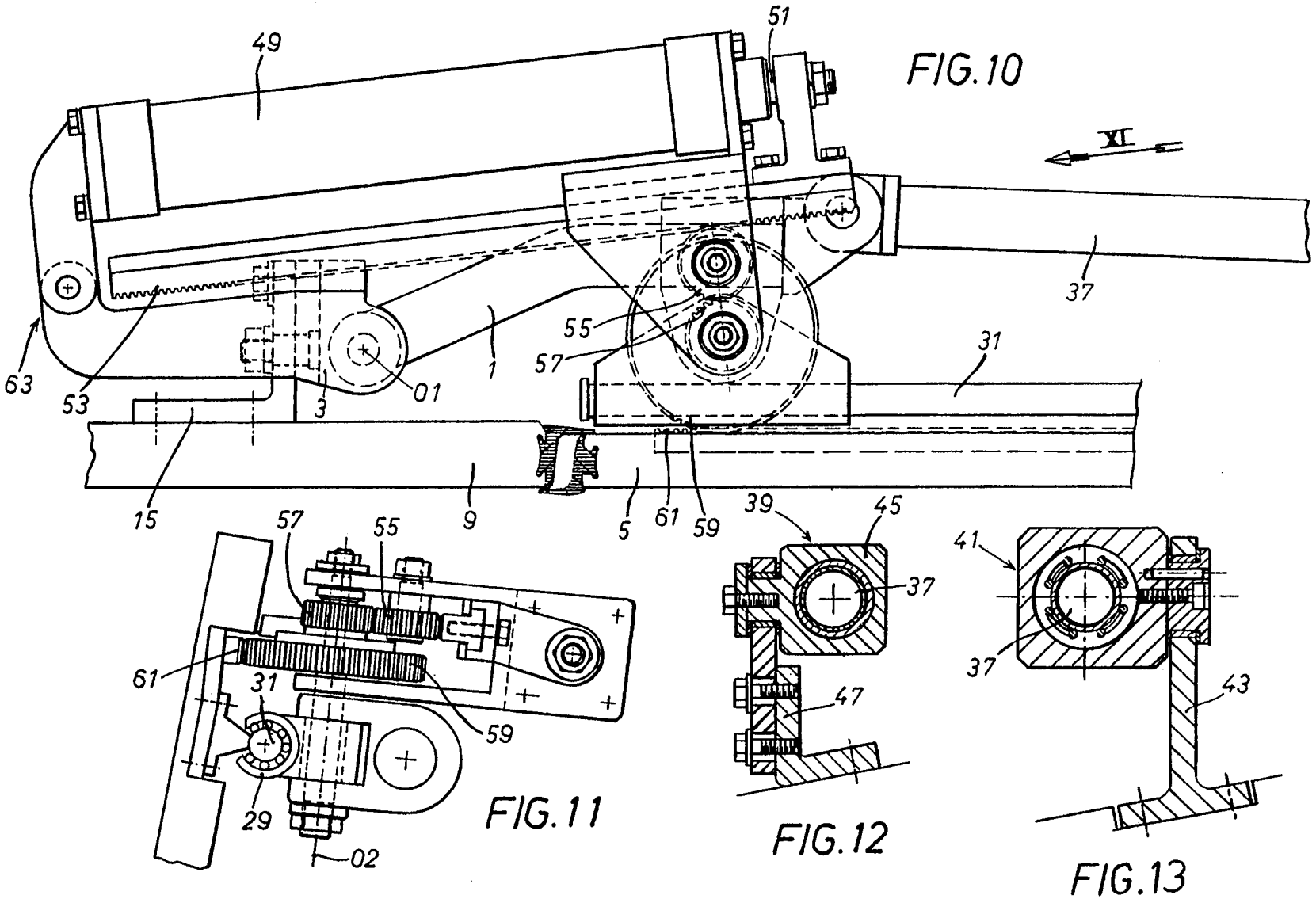

FIG. 9 is a schematic view of FIG. 8 as viewed along arrow IX;

FIG. 10 is a schematic top view from FIG. 1 wherein the upper portion of FIG. 10 corresponds to the front view of FIG. 1, showing the door translation device according to the invention;

FIG. 11 is a schematic view of FIG. 10 as viewed along arrow XI;

FIG. 12 is a schematic cross section along line XII—XII of FIG. 5;

FIG. 13 is a schematic cross section along line XIII—XIII of FIG. 5.

As it is evident from the figures, the subject device substantially comprises:

an upper ejection drive assembly and a translation guide with variable centers;

a door translation drive assembly;

a lower ejection drive assembly;

where the term ejection means a partial rotation of the arms secured to the fixed structure and to the door in order to accomplish the initial separation from and the final approach to the doorway of said door.

The upper drive assembly substantially comprises an ejection drive arm 1 which is joined at its base end in correspondence of the rotation axis 01, to a hinge member 3 allowing for an angular rotation movement, together with the movement of a lower drive assembly having substantially a similar construction, the angular rotation movement being enough to accomplish the ejection of the door 5, i.e. the separation of said door from the doorway 7 of the fixed structure in which said doorway 7 is provided.

Also such lower drive assembly comprises an ejection drive arm 11 which is joined at its base end in correspondence of the rotation axis 06, to a hinge member 13 similar to hinge 3, allowing for a similar angular rotation movement enough to accomplish the ejection of the door 5 as already mentioned.

The hinge members 3 and 13 are mounted on corresponding and suitable bracket members 15 by means of a curved slot fastening arrangement 17 allowing for the change of their angular attitudes in respect of the plane parallel to the door surface 5, thus allowing for the alignment of the rotation centers 01, 06 of the hinge members 3 and 13 with the axis of rotation 01–06 of said arms 1 and 11.

Such bracket members 15 secured to the structure 9 carrying the doorway 7 constitute the first and the third linking points between the device and the structure 9.

The actuating means of said upper and lower ejection arms 1 and 11 comprises at least a rack 19 driven by a dedicated fluid pressure small cylinder 20, e.g. hydraulic or pneumatic, at least a gear wheel or gearing 21 secured to the rotation shaft 23 of the above mentioned ejection arms 1 and 11 engaging the rack 19; at their other end or free end, through a clamp 25 carrying a support 27 with an associated slide bush 29 pivoted at 02, said ejection arms 1 and 11 engage corresponding upper and lower slide bars 31 integral with the door 5.

Such coupling constitutes the first and third support or back up points for the door 5 itself.

The upper arm 1 carries at its end portion a support 33 acting like a half hinge into which a further support 35 is fitted, to complete the hinge arrangement at axis 03.

A circular cross section slideway or slide bar 57 fastened to the support 35 is connected bridgewise over a further bush-hinge support 39, a sleeve 41 provided with slide bushes being slidably mounted on said circular cross section slide bar 37, the sleeve being connected to the door 5 by means of a hinge arrangement of the respective movable axis 04 and bracket 43.

Said bracket constitutes the second back up point of the door 5.

Said bush-hinge support 39, formed by a block 45 drilled to accommodate the circular cross section slide bar 37 pivoted at 05 to a bracket 47, realizes the second linking point between the device and the structure 9 carrying the doorway 7.

The door translation drive assembly substantially comprises a pneumatic or fluid pressure cylinder 49 the rod 51 of which carries a rack 53 in turn engaging a gear wheel 55 which in turn meshes with another gear wheel 57 coaxially to which an additional gear wheel 59 is provided that in turn engages a further rack 61 secured to the door 5 to be translated.

The above assembly is connected, at the rear portion of the cylinder 49, to a hinge 63 secured to the structure 9 by one of the above illustrated half hinges; the whole assembly being integral with the upper ejection arm 1 through the keying of the gear wheel 59 to the pin that realizes the pivoting of axis 02.

This constraint consents to constantly keep to engage the gear wheel 59 and the rack 61 during the ejection (rotation) and translation movements of the door 5.

The lower ejection drive assembly is quite similar to the upper ejection drive assembly, so that it is deemed that the former has been sufficiently described by the illustration of the latter.

As already indicated, said lower ejection drive assembly comprises an arm 11 which is similar to the arm 1 and is joined to the half hinge 13 by means of the axis 06. Also this half hinge 13 is connected to the bracket 15 by a slotted fastening arrangement 17, quite similar to the slotted fastening arrangement described and shown with reference to the upper ejection drive assembly.

Of course the axes 01 and 06 are coincident with aligned supports.

The slotted fastening arrangement 17 of both upper and lower brackets 15 allows for the angular adjusting of axes 01–06 to achieve the above mentioned alignment.

This adjustment renders the device adapted to be applied to doors that close over doorways of curved or otherwise shaped side frames, since it is always possible to obtain the alignments between the axes 01–06; which is the essential requirement for carrying out the rotation of the two arms 1 and 11 causing the ejection of the door 5.

The arm 1 and the arm 11 are axially connected by a torsion bar 24 substantially coincident with the shaft 23 which takes care of transmitting the angular movement from an arm to the other and vice versa; this way it is further prevented any time difference between the two movements.

The torque which is required to cause the rotation of the arms 1 and 11 can of course be applied without difference to either one of the arms, or simultaneously to both of them. Evidence this is a matter of design choice, depending on the available space or the door weight.

In the case that has been illustrated and described, such torque is applied to axes 01–06, and is generated by a system able to turn the linear movement of a cylinder rod into a circular motion.

I claim:

1. A device for opening and closing a door comprising:

a. a door;

b. a frame adapted to receive the door;

c. first rotating means located adjacent to an upper portion of the door for ejecting the door away from the frame, the first rotating means comprising a first arm rotatably mounted at one end to a first hinge member that is fastened to the frame and rotatably mounted at the other end to a first bracket that slidably mounted to the door, wherein the first hinge member comprises means for adjusting the axis of rotation of the first arm;

d. second rotating means located adjacent to a lower portion of the door for ejecting the door away from the frame, the second rotating means comprising a second arm rotatably mounted at one end to a second hinge member that is fastened to the frame and rotatably mounted at the other end to a second bracket that is slidably mounted to the door, wherein the second hinge member comprises means for adjusting the axis of rotation of the second arm to substantially coincide with the axis of rotation of the first arm;

e. means for rotating the first and second arms comprising first drive means for driving a first rack that engages at least one gear that is in driving engagement with a rotating shaft to which at least one of the first and second arms are connected at their axes of rotation;

f. means for translating the door in a direction substantially parallel to the plane of the frame once the door has been ejected from the frame comprising second drive means rotatably mounted at one end to the frame and having a movable rod at the other end fastened to a second rack that engages a gear that is in driving engagement with a third rack that is fastened to the door;

g. a slide bar rotatably mounted at one end to the frame and rotatably mounted at the other end to the first arm; and h. a sleeve slidably mounted on the slide bar and rotatably mounted on a support member that is fastened to the door.

2. A device according to claim 1, wherein the first and second hinge members comprise brackets fastened to the frame having curved slots for adjustably mounting hinges thereto to thereby permit adjustment of the axes of rotation of the first and second arms.

3. A device according to claim 1, wherein the first drive means comprises a fluid pressure cylinder.

4. A device according to claim 3, wherein the pressure cylinder is hydraulic.

5. A device according to claim 3, wherein the pressure cylinder is pneumatic.

6. A device according to claim 1, wherein the first drive means comprises an electric motor.

7. A device according to claim 1, wherein the first drive means comprises a fluid motor.

8. A device according to claim 1, wherein the rotating shaft is a torsion bar connected to both the first and second arms that synchronizes the rotation of the first and second arms.

9. A device according to claim 1, wherein the rotating shaft is connected to one of the first or second arms.

10. A device according to claim 1, wherein the gear that is in driving engagement with the third rack is rotatably mounted to the first bracket to which the first arm is rotatably mounted.

11. A device according to claim 1, wherein the second drive means comprises a fluid pressure cylinder.

12. A device according to claim 11, wherein the fluid is liquid.

13. A device according to claim 1, wherein the fluid is gaseous.

14. A device according to claim 1, wherein the first and second brackets are slidably mounted to the door by means of slide rails fastened to the door and sleeves connected to the first and second brackets.

15. A device according to claim 14, wherein the sleeves connected to the first and second brackets are mounted to the slide rails by means of bearings.

16. A device according to claim 1, wherein the sleeve mounted on the slide bar is slidably mounted thereon by means of bearings.

17. A device according to claim 16, wherein the end of the slide bar that is mounted to the frame has a triangular cross-section and the portion of the slide bar on which the sleeve is mounted has a circular cross-section.

* * * * *

UNITED STATES PATENT AND TRADEMARK OFFICE

CERTIFICATE OF CORRECTION

PATENT NO. : 5,347,757
DATED : September 20, 1994
INVENTOR(S) : Losito Pietro

It is certified that error appears in the above-indentified patent and that said Letters Patent is hereby corrected as shown below:

On the title page, item [54]

Title after "CLOSING A" and before "IN RAILWAY" --DOCK-- should be --DOOR--.

Column 1, Title after "CLOSING A" and before "IN RAILWAY" --DOCK-- should be --DOOR--.

Column 3, Line 60 after "bar" and before "fas-" --57-- should read --37--.

Column 4, line 55 after "of them." and before "this is a matter" --Evidence-- should be --Evidently--.

Signed and Sealed this

Third Day of October, 1995

*Attest:*

Bruce Lehman

BRUCE LEHMAN

*Attesting Officer*

*Commissioner of Patents and Trademarks*